US005116073A

United States Patent [19]

Goud

[11] Patent Number: 5,116,073

[45] Date of Patent: May 26, 1992

[54] SAFETY SKI BINDING

[75] Inventor: Gilles R. Goud, Cran Gevier, France

[73] Assignee: Salomon S.A., Annecy Cedex, France

[21] Appl. No.: 432,240

[22] Filed: Nov. 6, 1989

[30] Foreign Application Priority Data

Nov. 8, 1988 [FR] France ..... 88 14550

[51] Int. Cl.[5] ..... A63C 9/08

[52] U.S. Cl. ..... 280/617; 280/633

[58] Field of Search ..... 280/607, 617, 633, 636; 441/68, 70

[56] References Cited

U.S. PATENT DOCUMENTS

| | | | |
|---|---|---|---|
| 2,382,149 | 8/1945 | Hartman | 441/70 |
| 3,703,013 | 11/1972 | Leach | 441/70 |
| 3,785,666 | 1/1974 | Pierre et al. | 280/623 |
| 3,960,384 | 6/1976 | Salomon | 280/623 |
| 4,130,296 | 12/1978 | D'Antonio et al. | 280/607 X |
| 4,157,193 | 6/1979 | Beyl | 280/633 |
| 4,310,170 | 1/1982 | Linecker | 280/633 X |
| 4,519,625 | 5/1985 | Luitz et al. | 280/607 X |
| 4,522,424 | 6/1985 | Luitz et al. | 280/633 |
| 4,589,674 | 5/1986 | Krob et al. | 280/633 |
| 4,620,719 | 11/1986 | Stritzl | 280/633 |
| 4,681,339 | 7/1987 | Himmetsberger et al. | 280/633 |
| 4,690,424 | 9/1987 | Spitaler et al. | 280/633 |
| 4,699,398 | 10/1987 | Luschnig et al. | 280/633 |
| 4,773,886 | 9/1988 | Teeter et al. | 280/633 X |
| 4,817,981 | 4/1989 | Desbiolles et al. | 280/633 |

FOREIGN PATENT DOCUMENTS

| | | | |
|---|---|---|---|
| 0098515 | 1/1984 | European Pat. Off. . | |
| 0169315 | 1/1986 | European Pat. Off. . | |
| 0190608 | 8/1986 | European Pat. Off. . | |
| 3015478 | 11/1980 | Fed. Rep. of Germany | 280/633 |
| 3714001 | 11/1987 | Fed. Rep. of Germany | 280/617 |
| 2451756 | 11/1980 | France | 280/633 |
| 2454822 | 4/1982 | France . | |
| 2614545 | 11/1988 | France . | |

*Primary Examiner*—Andres Kashnikow
*Assistant Examiner*—Brian L. Johnson
*Attorney, Agent, or Firm*—Sandler, Greenblum & Bernstein

[57] ABSTRACT

A safety ski binding having a longitudinal slide affixed to the ski and a body supporting a retention jaw for one end of a boot to be mounted on the ski and an energization mechanism for the jaw, the body being solidly affixed to a base mounted for longitudinal sliding on the slide, a mechanism to immobilize the base and, consequently, the body on the slide in one of several different longitudinal positions. The immobilization mechanism includes, on one of the two elements that the base and the slide constitute, a succession of notches generally aligned longitudinally, forming a rack, respectively determining the different longitudinal positions that the body can occupy on the slide and, on the other element, an elastically biased latch having, with respect to the succession of notches, at least one tooth. The tooth of the latch is elastically biased in the direction of the notches so as to be able to become engaged in one of the notches to immobilize the body on the slide in the desired longitudinal position, wherein the binding includes a removable wedge inserted between a support surface and a portion of the latch so as to hold the latch normally in its release position in which its tooth is separated from the latching notch, and to allow the locking of the latch by engagement of its tooth in one of the notches, following the removal of the wedge.

23 Claims, 5 Drawing Sheets

4
3
1
2
5
8
7
6
9a
10
9
9b
II
9c
15
5a
13
12
14
11

4
3
1
IV
9b
10
9a
8
7
6
9
14
9c
2
15
12
5a
13
11

1
9c
14
11
5
2
12

14
15

1
5a
9c
5
9
11
2
13
12

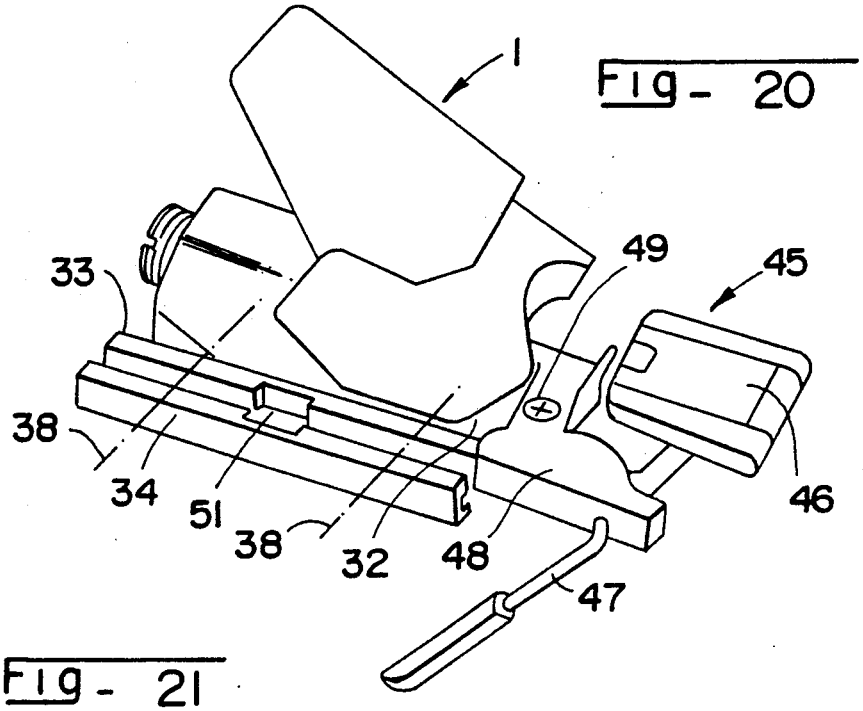
Fig- 20
Fig- 21
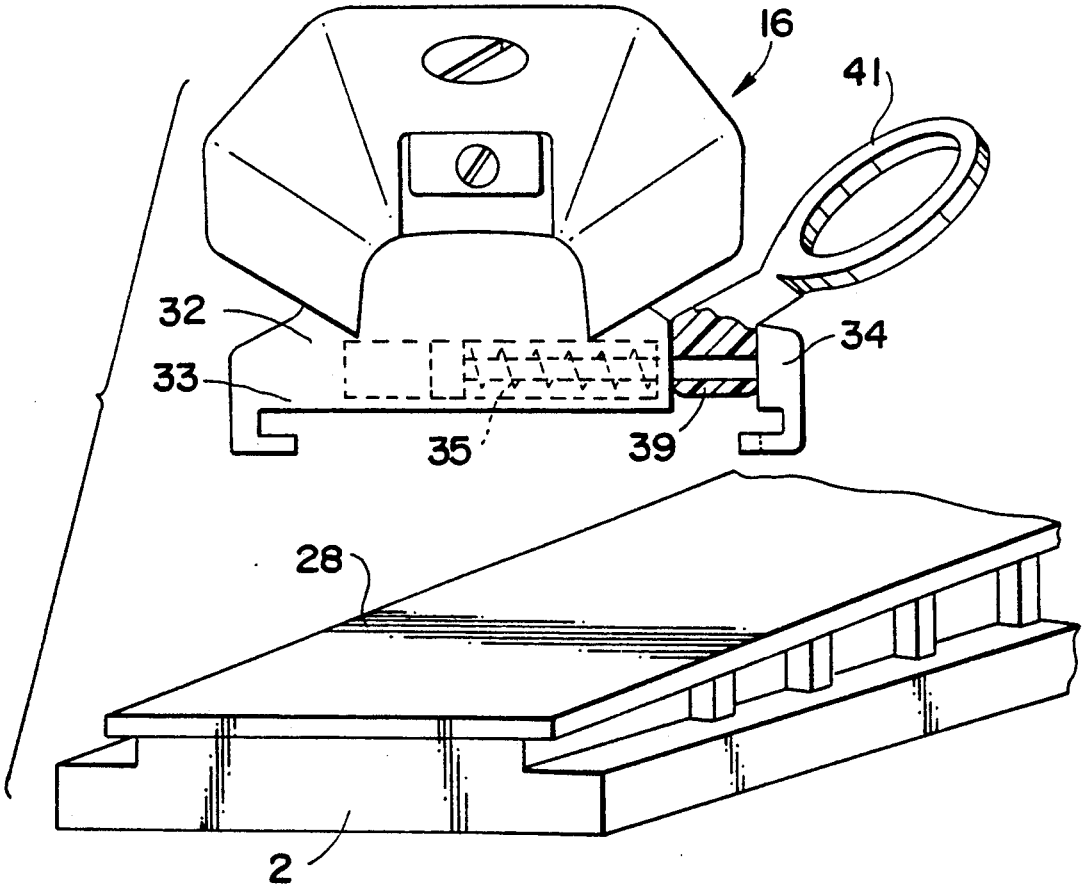

SAFETY SKI BINDING

BACKGROUND OF THE INVENTION

1. Field of the Invention

The present invention is directed to a safety binding for a ski constituted by two principal portions, namely, a longitudinal slide affixed to the upper surface of the ski and a body which is movably mounted longitudinally on the slide and which can be immobilized on the slide in one of a number of different longitudinal positions.

2. Description of Background and Relevant Information

Various ski bindings are known, both front bindings for securing the front of the shoe or boot and rear bindings for securing the rear of the shoe or boot, which provide for longitudinal adjustment of the body of the binding to adapt the binding to the particular length of the shoe or boot to be mounted on the ski, as well as to adjust the intensity of the force which is exerted against that shoe or boot between the front and rear bindings. In such safety bindings, a slide is typically provided which is affixed to the ski and which has, over at least a portion of its length, a track constituted by a succession of notches longitudinally spaced from one another which respectively determine the different longitudinal positions that the body of the binding can occupy on the slide.

A latch cooperates with the notches, the latch being movably mounted on the lower portion of the body of the binding which constitutes a base in contact with the slide and which slides thereon. The latch carries at least one projection, or tooth, positioned in a manner so as to be able to be displaced in the longitudinal direction while facing the succession of notches of the track when one slides the body longitudinally on the slide. The latch is elastically fixed to a spring in a manner such that a projection thereof is constantly biased in the direction of the slide, and such that it can be engaged in one of the notches so as to immobilize the body of the binding in the desired longitudinal position on the slide.

Furthermore, the latch is provided with an element to move it against the biasing action of its return spring when one desires to disengage the projection of the latch from the notch in which it is located so as to adjust the longitudinal position of the body of the binding. Such a safety binding is described, for example, in French Patent Application No. 2,454,822.

The slide of the safety binding can accompany the body of the above-described binding during its manufacture and its assembly and, in this case, the initial operation required for the mounting of the binding on the ski includes affixing the slide to the ski by means of screws. Alternatively, however, the ski itself can be provided with the slide affixed in position in which case only the body of the binding must be mounted on the slide. In either case, it is necessary to adjust the body of the binding in the appropriate longitudinal position on the slide, which operation requires that, during the sliding movement, the latch must remain raised such that its projection can pass without interference over the notches provided in the slide, which constitutes the adjustment the track. Consequently, this requires (1) that the assembler grips, with one of his or her hands, the body of the binding which is engaged on the slide to make it slide longitudinally and (2) with the other hand, that the latch is raised with an appropriate tool during the entire sliding movement of the body on the slide. This operation tends to be inconvenient for mounting the binding and, furthermore, the final longitudinal positioning of the body of the binding does not occur automatically.

Other bindings of this general type, which are improvements over the binding disclosed in the aforementioned French application, are disclosed in U.S. Patent Application Ser. No. 07/394,721, which was filed on Aug. 16, 1989, and which is commonly assigned herewith. The disclosure of the aforemention U.S. application is hereby incorporated by reference with respect to the arrangement and operation of the various parts of the disclosed bindings, as well as with respect to the discussions of the problems associated with known bindings and the need for solutions therefor.

SUMMARY OF THE INVENTION

It is an object of the present invention to provide solutions to the problems described above in connection with known bindings by providing a safety binding for a ski including a longitudinal slide affixed to the ski and a body supporting a retention jaw for one end of a boot to be mounted on the ski, the body being solidly affixed to a base, the base being longitudinally slidably mounted on the slide. The binding further includes means for immobilizing the base and, consequently, the body on the slide in one of several different longitudinal positions, the immobilization means including, on one of the base and the slide, a succession of notches aligned longitudinally, forming a rack, respectively determining the different longitudinal positions that the body can occupy on the slide and, on the other element, an elastically biased latch including, facing the succession of notches, at least one tooth, the tooth of the latch being elastically biased in the direction of the notches so as to be able to engage in one of the notches to thus immobilize the body on the slide in the desired longitudinal position. The binding further includes a removable wedge or shim interposed between a support surface and a part of the latch so as to normally hold the latch in the release position in which the tooth is separated from the latching notches and to allow the locking of the latch, by engagement of the tooth in one of the notches following the removal of the wedge.

In one embodiment of the invention, the safety binding constitutes a heel binding for the holding of the rear end of a boot, in which the slide has, in a central part, a rack constituted by a succession of notches aligned longitudinally, with which the latch cooperates, the latch being mounted for rocking in the vertical direction, about a transverse axis, on the base of the heel binding, wherein the wedge is engaged longitudinally between the upper surface of the extreme rear part of the base and an extreme rear arm of the latch.

Further according to this embodiment, the latch includes a central part, offset downwardly with respect to a front wing and which is engagable, with a significant longitudinal play, in a longitudinal slot of the base, the central part of the latch supports, on its lower surface, at least one tooth adapted to engage in one of the notches of the slide and the latch is biased elastically, by a return spring resting on the latch, so that the tooth is constantly biased downwardly.

In a particular aspect of the invention, the removable wedge is solidly affixed to a ring forming a pull handle, extending longitudinally and projecting to the exterior, at the rear of the heel binding, so as to permit the removal of the wedge by longitudinal pulling towards the rear.

In another aspect of the invention, the removable wedge is solidly affixed to a lug extending transversely through a lateral housing of the binding, projecting to the exterior, on one side of the binding, and connected to an external pull ring.

It is further object of the invention to provide a binding in which the body or the base supports a locking latch in a longitudinal position, the latch being constituted by a vertically movable rod in a housing of the body, downwardly biased by a spring so that a lower end of the rod can engage in one of the notches so as to immobilize the body of the binding in a desired longitudinal position, wherein the removable wedge is engaged transversely between a support surface of the body or of its base and the marginal part of a plate which is elastically biased on the body or the base of the binding and the upper end of the rod forming a locking latch which is journalled about the plate so that the locking latch is lifted when the wedge is engaged under the plate, against the elastic biasing of the spring.

It is a still further object of the invention to provide a binding having a base which includes a transverse collet chuck which is constituted by two jaws transversely movable with respect to one another and elastically biased towards one another, and a removable wedge solidly affixed to a pull ring is interposed between the two jaws of the chuck that constitutes the base, the thickness of the wedge thus interposed being selected such that the two jaws are kept separated from one another by a sufficient distance to permit the nesting of the base on the slide and longitudinal sliding to the desired longitudinal position of the binding.

Further, the base includes a first jaw, of relatively great transverse dimension, including an upper part extending over substantially the entire width of the base, and a lateral part curved downwardly, forming a hook opening in the direction of the hook of the first jaw.

Still further, the second jaw is elastically biased in the direction of the first jaw under the action of at least one compression spring which is lodged in a transverse opening provided in an upper part of the first jaw, the compression spring resting, at its end situated on the side of the second jaw, on the bottom of the housing and, at its other end, on a head provided at the end of a transverse tie rod which crosses the bottom of housing and which is solidly affixed, on the exterior, to the second jaw.

Still further, the locking in the longitudinal position is ensured by the engagement of teeth, provided on one or the other of two jaws or on both of the two jaws, in notches provided on one or the other of the longitudinal edges of the slide or on both of the two edges thereof.

Still further, the teeth used for the locking of the binding in longitudinal position are provided along the lateral surfaces of a projection of the ski, underneath the marginal parts of the slide, between the lower surface of the slide and the upper surface of the ski and with the teeth or notches defined between the successive teeth cooperate notches or teeth provided in the edge of the lower hook-shaped part of the corresponding jaw.

Still further, a housing is provided in the two surfaces in contact with two jaws and the housing opening into the upper surface of the jaws to permit the introduction of a tool, such as a screwdriver, for separating the two jaws from one another.

It is an additional object of the invention to provide a ski binding including:

(a) a binding body adapted to be selectively positioned at any of a plurality of locations on a ski;

(b) a latch mounted with respect to the binding body for movement between a locked position for immobilizing the binding body with respect to the ski and an unlocked position for permitting the binding body to be moved to any of the plurality of locations on the ski;

(c) means for biasing the latch to the locked position;

(d) a support portion toward which a portion of the latch is biased by the biasing means; and (e) means for maintaining the latch in the unlocked position including an element for engagement between a portion of the latch and the support portion, thereby enabling the binding body to be moved to any of the plurality of locations on the ski.

In a further aspect of the invention, the binding includes a slide adapted to be mounted upon the ski and the binding body includes means for slidable engagement with the slide for permitting the binding body to be longitudinally slidable along the slide.

Still further, the plurality of locations on the ski are defined by a plurality of longitudinally spaced notches provided in the slide, and the latch includes at least one tooth for selective engagement within a selected one of the plurality of notches.

Still further, the portion of the latch engaged by the element for engagement between the portion of the latch and the support portion of the binding for maintaining the latch in the unlocked position is movable between a position corresponding to the locked position of the latch and a position corresponding to the unlocked position of the latch, and wherein, in the position of the portion of the latch corresponding to the unlocked position of the latch, the at least one tooth is maintained withdrawn from the selected one of the plurality of notches.

According to a further aspect of the invention, the support portion of the binding is located between the slide and the portion of the latch, when the binding is slidably engaged with the slide.

In one embodiment, the binding is a rear binding for engagement with a rear portion of a ski boot. In another embodiment, the binding is a front binding for engagement with a front portion of a ski boot.

In a further aspect of the invention, the binding includes a base upon which the body of the binding is mounted, the base including a slot through which the at least one tooth is adapted to project during its engagement with the selected one of the notches.

According to a further aspect of the invention, the support portion of the binding is a portion of the base.

Still further according to the present invention, the latch includes an offset portion, from which the at least one tooth projects, the offset portion being longitudinally movable within the slot.

Still further according to the present invention, the plurality of locations on the ski are defined by a plurality of longitudinally spaced notches provided in the slide, and the latch includes a generally vertically movable rod which is biased toward engagement with a selected one of the plurality of notches.

Further according to this aspect of the invention, the support portion is included by a portion of the binding body and the portion of the latch is a plate connected to the movable rod.

In a further aspect of the invention, the latch is mounted for transverse movement relative to the ski, and the biasing means biases the latch in a transverse direction.

It is an additional object of the invention to provide a binding which includes a base upon which the body is mounted, the base including a first jaw for engagement with the slide and the latch including a second jaw for engagement with the slide, and wherein the second jaw is biased toward the first jaw by the biasing means.

In an additional aspect of the invention, a projection is provided for the ski upon which the slide is adapted to be mounted, wherein the plurality of locations on the ski are defined by a plurality of longitudinally spaced teeth or notches provided on the projection for being engaged by a portion of the latch.

It is a still further object of the invention to provide an assembly including:

(a) a platform adapted to be mounted upon a ski, the platform including a first part having means for receiving one of a heel binding and a toe binding, and a second part having means for slidably receiving the other binding of the heel binding and the toe binding;

(b) a latch mounted with respect to the other binding for movement between a locked position for immobilizing the other binding with respect to the ski and an unlocked position for permitting the other binding to be moved to any of the plurality of locations on the ski;

(c) means for biasing the latch to the locked position;

(d) a support portion toward which a portion of the latch is biased by the biasing means; and (e) means for maintaining the latch in the unlocked position including an element for engagement between a portion of the latch and the support portion, thereby enabling the other binding to be moved to any of the plurality of locations on the ski.

In a particular aspect of the invention, both of the toe binding and the heel binding are slidably receivable on the first part and the second part of the platform, respectively.

It is a still further object of the invention to provide a method of positioning a ski binding upon a ski, in which the ski binding includes a body which is selectively positioned at any of a plurality of locations on the ski and a latch mounted for movement with respect to the binding body between a locked position for immobilizing the binding body with respect to the ski and an unlocked position for permitting the binding body to be moved to any of the plurality of locations on the ski, the method including the steps of:

(a) providing an element engaged between a portion of the latch and a support portion of the binding for maintaining the latch in the unlocked position;

(b) positioning the binding upon the ski with the latch in the unlocked position;

(c) moving the binding to a selected one of the plurality of locations on the ski; and (d) removing the element from engagement between the portion of the latch and the support portion, permitting the latch to moved to the locked position.

BRIEF DESCRIPTION OF THE DRAWINGS

The present invention will now be described below, by way of non-limiting examples or embodiments, with reference to the annexed drawings in which:

FIG. 20 is a perspective view of an assembly constituted by a rear binding and a ski brake; and FIG. 21 is a perspective view of a slide on which a front binding, shown from the front, is to be mounted, its jaws being maintained separated by the removable wedge.

DETAILED DESCRIPTION OF PREFERRED EMBODIMENTS

Figure 1:
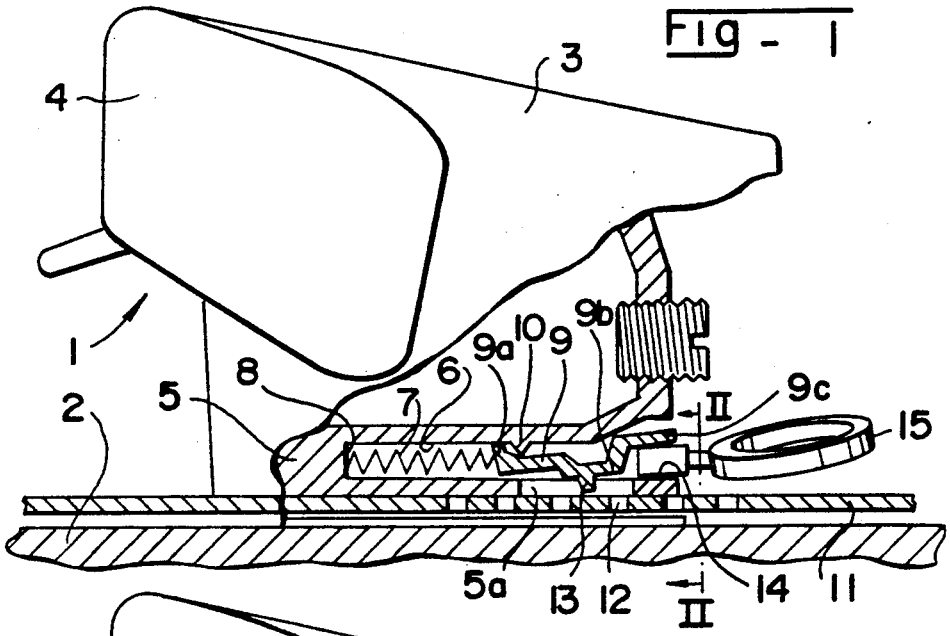
FIG. 1 is an elevation view, partially in vertical and longitudinal section, of a heel binding according to the invention whose body is engaged on a slide affixed to the ski, before the final positioning of the body of the binding in the desired longitudinal position.

It is an object of the present to overcome the disadvantages mentioned above with regard to known bindings by providing a safety binding having means making it possible to considerably simplify the mounting of the binding and the adjustment of its longitudinal position.

To that end, the safety ski binding of the present invention includes a longitudinal slide affixed to the ski and a body supporting a retention jaw for one end of a boot to be mounted on the ski and an energization mechanism for the jaw, the body being solidly affixed to a base mounted for longitudinal sliding on the slide, means to immobilize the base and, consequently, the body on the slide in one of several different longitudinal positions. The immobilization means comprises, on one of the two elements that the base and the slide constitute, a succession of notches generally aligned longitudinally, forming a rack, respectively determining the different longitudinal positions that the body can occupy on the slide and, on the other element, an elastically biased latch comprising, with respect to the succession of notches, at least one tooth. The tooth of the latch is elastically biased in the direction of the notches so as to be able to become engaged in one of the notches to immobilize the body on the slide in the desired longitudinal position, wherein the binding includes a removable shim or wedge inserted between a support surface and a portion of the latch so as to hold the latch normally in its release position in which its tooth is separated from the latching notch, and to allow the locking of the latch by engagement of its tooth in one of the notches, following the removal of the shim or wedge.

The safety binding according to the invention which is shown in FIGS. 1–4, is a heel binding 1 adapted to hold the rear end of a boot on a ski 2. The heel binding 1 includes a body 3 supporting, in its front part, a retention jaw 4 of the boot and containing an energization mechanism for the jaw. The body 3 is solidly affixed, at its lower part, with a base 5 which can slide longitudinally with respect to the ski. In the lower part of the body 3 a longitudinal opening 6 is provided in which a compression spring 7 is positioned, which constitutes a return spring. The compression spring 7 rests, at its front end, on a transverse surface 8 forming an abutment surface for body 3 and, at its rear end, on a frontal anterior wing 9a of an element 9 forming a pivoting latch. The frontal anterior wing 9a is pushed rearwardly against an internal projection 10 of base 5 and it thus constitutes a support for the rear end of spring 7.

The heel binding 1 further comprises a slide 11 which is affixed at the upper horizontal surface of ski 2 by any appropriate means, for example, by means of screws. The slide 11 is preferably constituted by a metallic plate and can be either originally assembled with base 5 of body 3 of the binding or affixed to the ski before the positioning of the body 3 of the binding. In all cases, base 5 and slide 11 are shaped so as to be engaged with respect to one another with a minimum of lateral play, while permitting a longitudinal sliding of base 5 and, consequently, of the body 3 with respect to the slide 11 affixed to the ski.

For the adjustment of the longitudinal position of the heel binding 1 the slide 11 has, in its central part, a rack constituted by a succession of notches 12, generally aligned longitudinally. These notches can be holes extending completely through the slide 11 or cutouts hollowed in on part of the thickness of the slide. The notches 12 can have various shapes and particularly they can have, in plan view, an elongated rectangular shape in the transverse direction. Latch 9, which is mounted for rocking in a generally vertical direction about a transverse axis on base 5 of heel binding 1, cooperates with notches 12. The latch 9 comprises a central part 9b offset downwardly with respect to its anterior wing 9a and which can engage with a significant longitudinal play in a longitudinal slot 5a of base 5. The central part 9b of the latch 9 supports, on its lower surface, at least one tooth 13 adapted to engage in one of notches 12 of slide 11. The latch 9 is elastically biased in such a manner that tooth 13 is constantly pushed downwardly. In this embodiment, the elastic biasing of the latch 9 is ensured by the return spring 7 pushing the anterior wing 9a of the latch 9 towards the rear. The latch 9 is thus biased constantly in a clockwise direction in FIG. 1.

Figure 3:
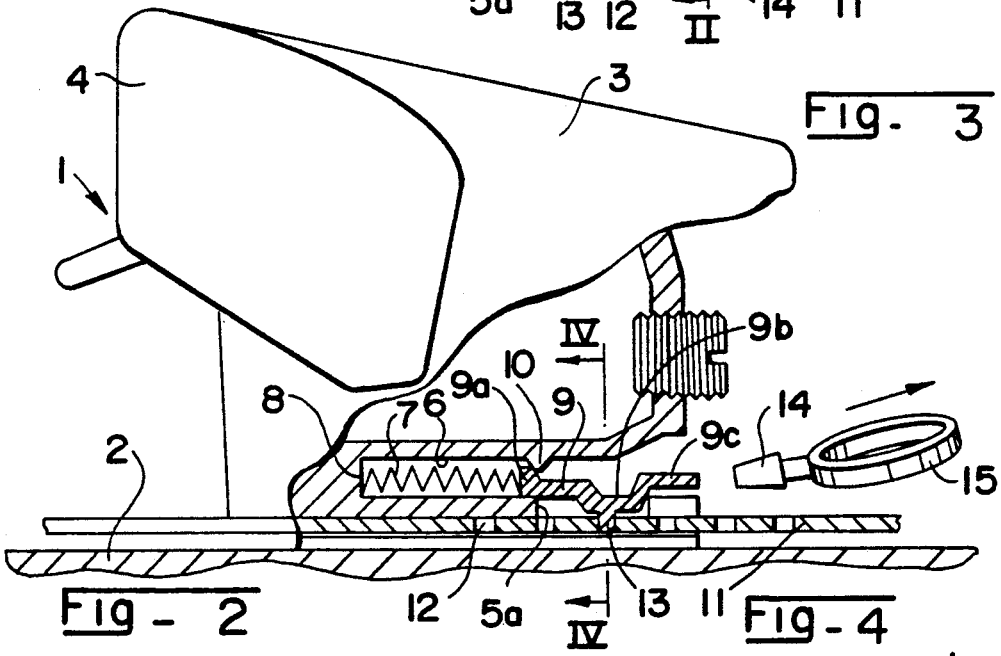
FIG. 3 is an elevation view, partially in vertical and longitudinal section, of the heel binding of FIG. 1 immobilized in the desired longitudinal position.
Figure 2:
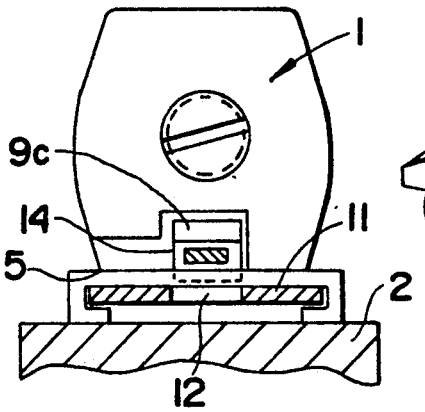
FIG. 2 is a vertical and transverse sectional view along line II—II of FIG. 1.
Figure 5:
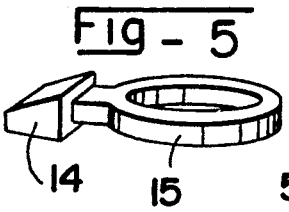
FIG. 5 is a perspective view of the removable wedge and its pull ring.
Figure 4:
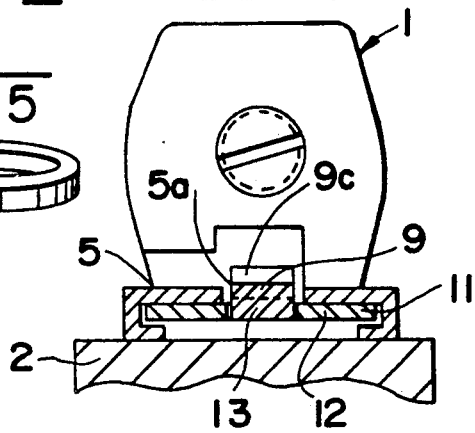
FIG. 4 is a vertical and transverse sectional view along line IV—IV of FIG. 3.
Figure 6:
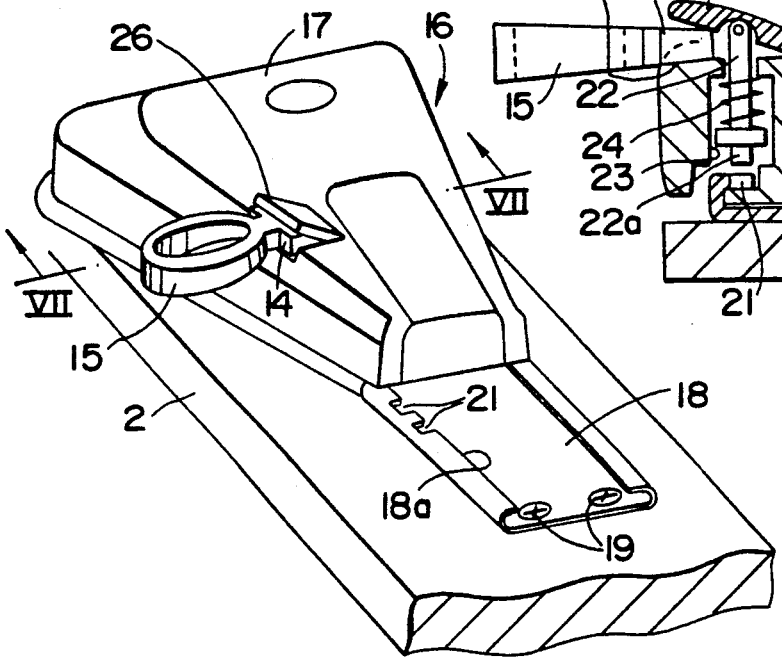
FIG. 6 is a perspective view of a front binding whose body is adjustably mounted on a longitudinal slide affixed to the ski, before the final positioning of the body of the binding in the desired longitudinal position.
Figure 7:
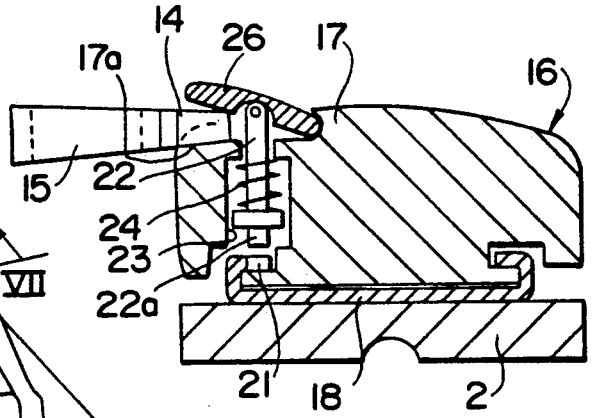
FIG. 7 is a vertical and transverse sectional view along line VII—VII of FIG. 6.
Figure 8:
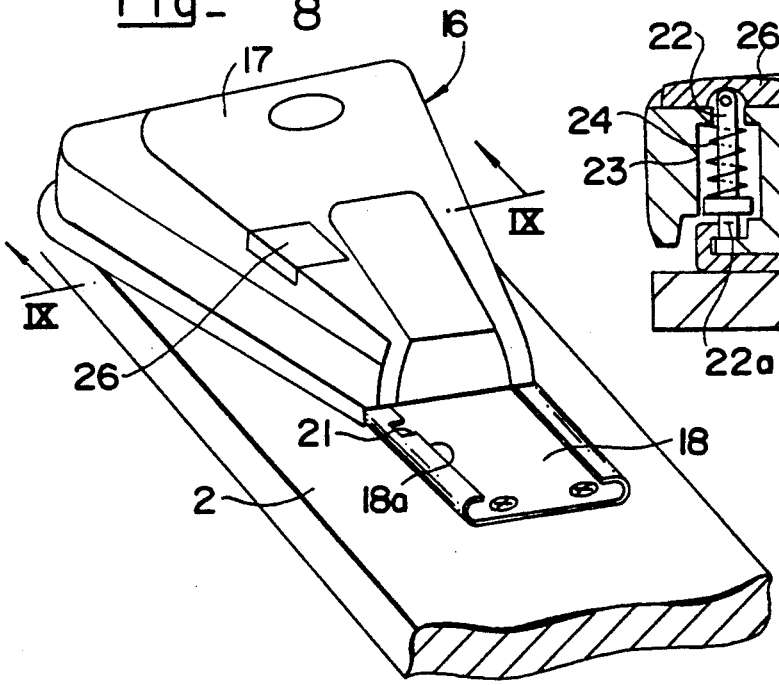
FIG. 8 is a perspective view of the front binding of FIG. 6 after its immobilization in the desired longitudinal position.
Figure 9:
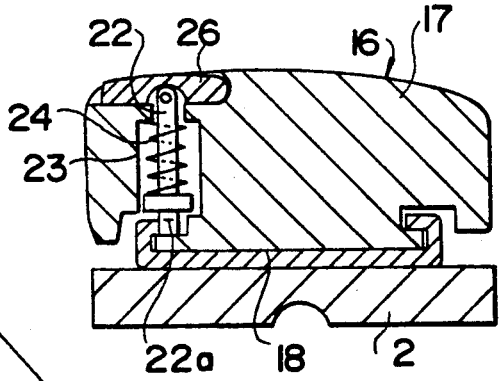
FIG. 9 is a vertical and transverse sectional view along line IX—IX of FIG. 8.
Figure 10:
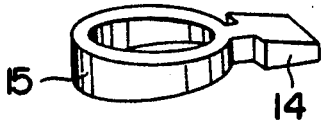
FIG. 10 is a perspective view of a removable wedge and its pull ring used in the front binding shown in FIGS. 6–9.

To facilitate the adjustment of the longitudinal position of heel binding 1, the heel binding is delivered, before mounting, with its latch 9 maintained raised in the release position by means of a removable wedge 14. The wedge 14 is engaged longitudinally between the upper surface of the extreme rear part of base 5 and an extreme rear arm 9c of latch 9. As a result, when the wedge 14 is thus engaged, as is shown in FIGS. 1 and 2, it maintains the rear arm 9c of latch 9 in a raised position so that the lower tooth 13 of the latch is totally retracted within slot 5a of base 5. The mounter can thus freely slide the body 3 of the heel binding on slide 11 to the desired longitudinal position. At the moment when this position is reached, or a little before, the mounter ejects the wedge 14 so that the latch 9 is then freed. Under the action of the return spring 7, the latch 9 tends to pivot in a clockwise direction and its lower tooth 13 is pressed under pressure against the upper surface of slide 11. If the tooth 13 is across from a notch 12, it engages in this notch and if such is not the case, a slight longitudinal sliding movement suffices for this engagement to take place. From that moment, the latch 9 is in the lowered latching position, as is shown in FIGS. 3 and 4. Its lower tooth 13 is engaged in a notch 12 and it thus immobilizes the latch 9 against any longitudinal displacement. From this moment, the anterior wing 9a of the latch 9 constitutes a fixed support abutment for the return spring 7 and, while being held in this longitudinal position, the body 3 of the heel binding 1 can nevertheless execute a longitudinal retraction movement which is necessary during skiing, this movement being made possible by the longitudinal slot 5a provided in base 5.

Preferably, the removable wedge 14 for holding latch 9 in the release position is solidly affixed to a ring 15 forming a pull handle, or tab, extending longitudinally and projecting to the exterior, at the rear of the heel binding, so as to permit the removal of the wedge 14 by longitudinally pulling towards the rear, as is indicated by the arrow in FIG. 3. According to an alternative embodiment, the pull ring could extend transversely, the ejection of the wedge 14 then taking place under the effect of a transverse pulling force.

As can be seen in FIG. 3, the rear arm 9c of latch 9 extends, in the latching position, a little above the upper surface of base 5 and its end is accessible from the rear of the heel binding 1. It is consequently possible to lift, by means of an appropriate tool engaged between the rear arm 9c of latch 9 and base 5, and to consequently rock the latch assembly 9 in a counterclockwise direction. This has the effect of disengaging the tooth 13 from its notch 12 and making it possible to longitudinally slide the heel binding 1 again to modify its longitudinal position.

FIGS. 6–9 show an alternative embodiment of the invention which is constituted, in this case, by a front or toe binding. As in the case of the rear binding 1 shown in FIGS. 1–4, the front binding 16 comprises a body 17 which is originally assembled with a slide 18 on which the body 17 is longitudinally adjustable by sliding. Once out of its packaging, the front binding 16 is affixed to ski 2, for example by means of screws 19 going through slide 18. Slide 18 has a vertical and transverse section generally in the shape of a C open upwardly and one of the upper longitudinal edges 18*a* of the slide 18 has a succession of notches 21 opening towards the interior. Furthermore, the body 17 supports a latch 22 for locking the binding in a longitudinal position. The latch 22 is constituted by a vertically movable rod in a housing 23 of the body 17 and which generally extends in a vertical and longitudinal plane passing through the locking notches 21. The rod 22 is constantly biased downwardly by a spring 24 and its lower end 22*a* is engagable in one of notches 21 so as to immobilize the body 17 of binding 16 in the desired longitudinal position.

According to the invention, the front binding 16 is delivered with its locking latch 22 held in retracted release position. This is achieved by means of an ejectable wedge 14 which is engaged transversely between a support surface 17*a* provided in the upper part of the body 17 and the marginal part of a plate 26 which is elastically mounted on body 17. The upper end of the rod 22 forming a locking latch is journalled on the plate 26 so that the locking latch 22 is lifted when the wedge 14 is engaged under the plate 26 against the elastic biasing due to spring 24. Consequently, during the mounting of the binding 16 on the ski 2, the mounter slides the body 17 of the binding on the slide 18 to the desired longitudinal position, this sliding being made possible by the locking latch 22 being maintained lifted by wedge 14. Once the desired longitudinal position is reached, it suffices to pull rearwardly on the wedge 14 by means of the handle 15 which is solidly affixed thereto to remove the wedge 14 and to free the plate 26. At that moment, the rod forming the locking latch 22 is lowered under the action of spring 24 and its lower end 22*a* engages in the desired notch 21 of slide 18. If the lower end 22*a* of the locking latch 22 is not exactly across from a notch 21 it suffices then to slightly slide the body 17 until the lower end 22*a* becomes engaged within a notch.

FIGS. 11–14 illustrate applications of the invention in the case where the slide is assembled on the ski 2 before the positioning of the body of the binding, the slide having been assembled previously on the ski or the ski having been delivered originally with a mounted slide. In this case, the slide 28 constitutes a plateform which is affixed to an upper longitudinal projection 2*a* of ski 2, this projection having a rectangular transverse section whose width is thus less than that of ski 2. The platform forming slide 28 itself has a width greater than that of the projection 2*a* but, however, less than that of ski 2 so that its two longitudinal sides 28*a* extend slightly beyond the two longitudinal edges of projection 2*a*, however, without reaching sides 2*b* and 2*c* of ski 2. The platform forming slide 28 comprises two parts, namely, a rear part 28*b* adapted to the mounting of a heel binding 1 and a front part 28*c* adpated to the mounting of a front binding 16, these two parts being connected to one another by a central part 28*d* of smaller width. The bases of the rear binding 1 and the front binding 16 generally have, in transverse cross-section, the shape of a C open downwardly whose width of the lower opening is selected to be slightly greater than the width of the central part 28*d* of slide 28, which permits the engagement of bindings 1 and 16, first by a movement generally perpendicular to the ski, then by a rearward longitudinal movement for the rear binding 1 and towards the front for the front binding 16.

The rear binding 1 is provided, as is shown in FIG. 1, with a latch 9 which is maintained raised, i.e., in the release position, by an ejectable wedge 14 solidly affixed to a handle 15 for facilitating pulling of the wedge. The latch 9 is adapted to engage by its lower tooth or teeth, in one of several notches 29, aligned longitudinally, provided in the rear part 28*b* of slide 28. The front binding 16 is, as for itself, provided with a locking latch 22 which is maintained raised in the retracted position, by means of a wedge 14, as has been illustrated in FIGS. 6–9. The locking latch 22 can engage in locking position in one of several notches 31 provided in a longitudinal edge 28*a* of the front part 28*c* of slide 28. The latch 22 is maintained raised in a release position by the wedge 14 which can be removed by pulling in the transverse direction on ring 15 which is solidly affixed thereto. The locking latch can be mounted at the rear of the base of the front binding 16 as is shown in FIG. 11, or even at the front thereof, on the side above the succession of notches 31 provided in the front part 28*c* of slide 28 as is shown in FIG. 12.

Figure 11:
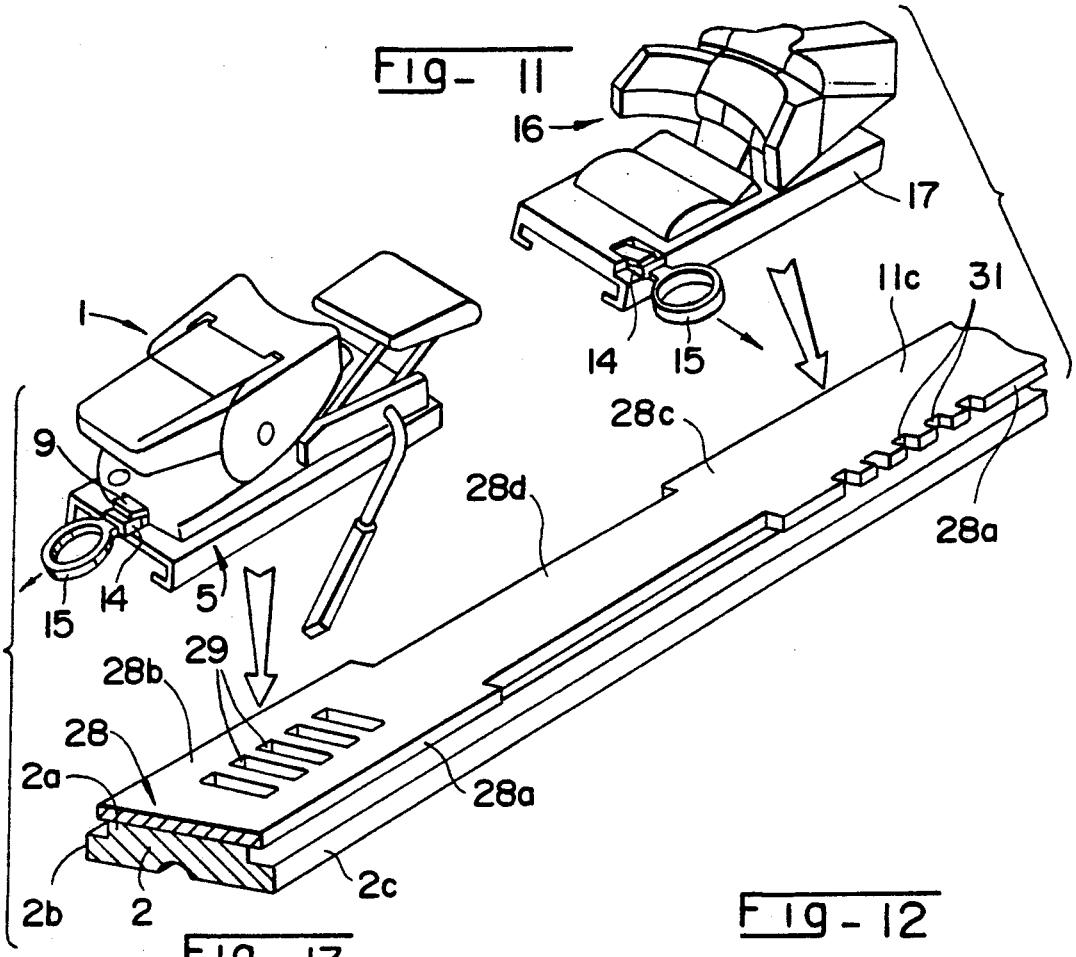
FIG. 11 is a perspective view of an assembly of a front binding and a rear binding adapted to be mounted on a common slide affixed to a ski.
Figure 12:
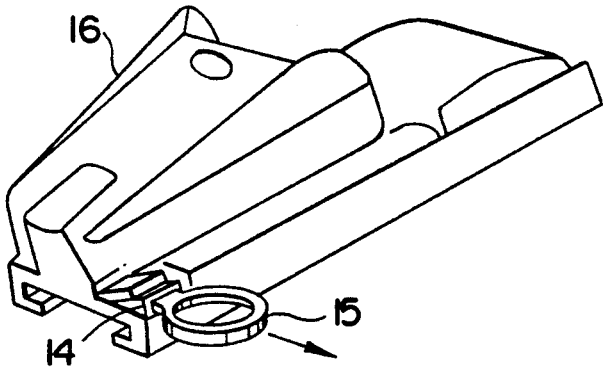
FIG. 12 is a perspective view of an alternative embodiment of the binding abutment.
Figure 13:
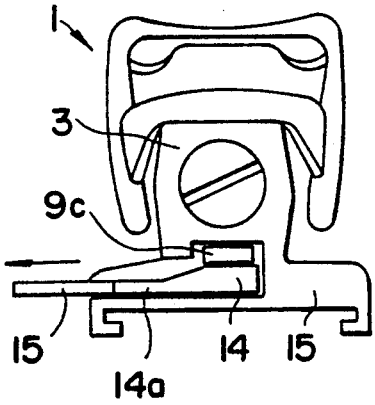
FIG. 13 is a rear view of a heel binding illustrating an alternative embodiment of the removable wedge.
Figure 14:
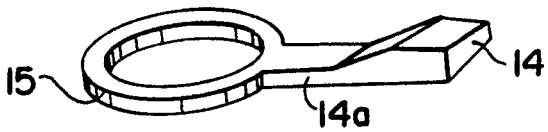
FIG. 14 is a perspective view of the removable wedge and its pull ring used with the rear binding of FIG. 13.

The removable wedge 14 which holds the latch 9 of the rear binding 1 in the release position can be removed either by a longitudinal pulling force as is shown in FIG. 11, or by a transverse pulling force as is shown in FIG. 13. To that end, the wedge 14 is extended laterally by a lug 14*a* which goes through a housing provided in base 5 to the pull ring 15. In this case, the ring 15 forming a pull handle extends transversely with respect to the wedge 14 which is itself engaged longitudinally.

If desired, only one of the two bindings shown in FIG. 11 could be made longitudinally adjustable, with the other binding being located in a predetermined position.

Figure 15:
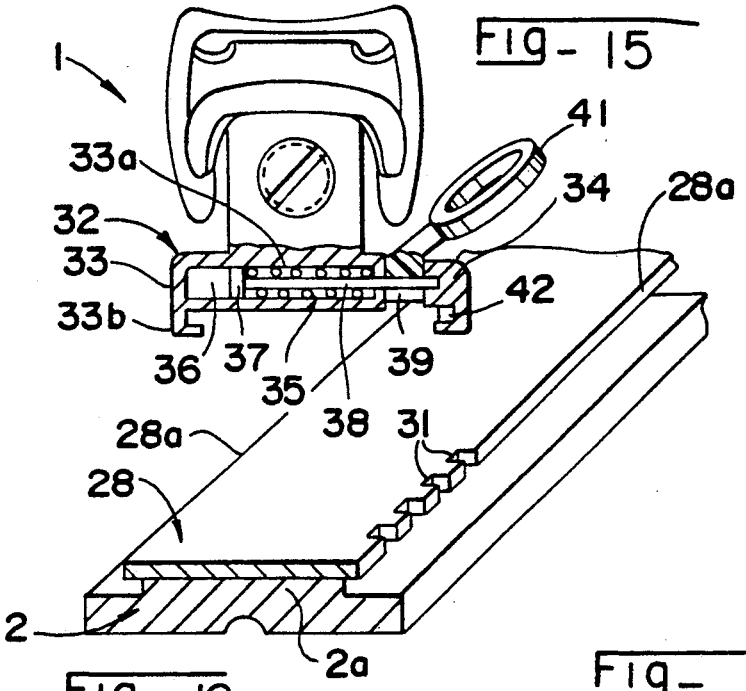
FIG. 15 is a perspective view of a slide on which a rear binding shown from the rear is to be mounted, partially in vertical and transverse section.
Figure 16:
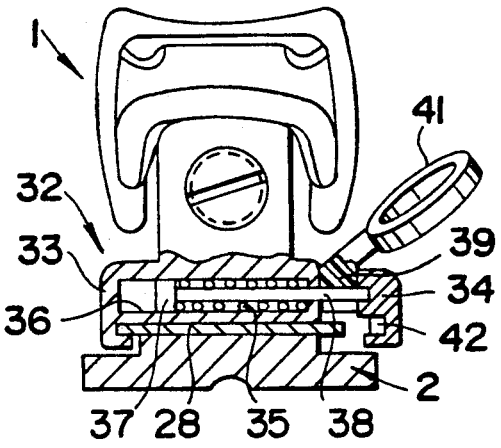
FIG. 16 is a vertical and transverse sectional view of the rear binding of FIG. 15 mounted on the slide, in the release position permitting its longitudinal sliding.
Figure 17:
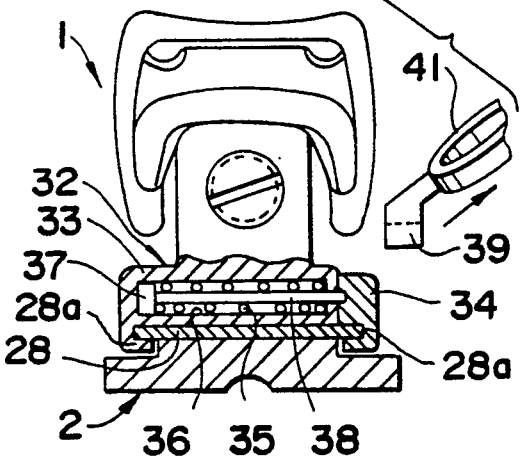
FIG. 17 is a vertical and transverse sectional view of the rear binding of FIG. 16 latched in longitudinal position.

In the alternative embodiment shown in FIGS. 15–17, the rear binding 1 does not comprise a locking latch arranged in longitudinal position, such as latch 9 of the embodiment illustrated in FIGS. 1–4, but this locking function is assumed by its base 32. This base 32, forming a transverse collet chuck is constituted by two parts 33 and 34 transversely movable with respect to one another and elastically biased to one another. The base forming chuck 32 has, in the usual manner, a transverse and vertical section generally in the shape of a C open downwardly and it includes a first part or jaw 33 of a relatively great transverse dimension comprising an upper part 33*a* extending over nearly the entire width of the base and a lateral part 33*b* curved downwardly, forming a hook facing towards the interior and a second part or jaw 34 which extends transversely and which essentially forms at its lower part a hook, opening towards the interior in the direction of hook 33*b* of the first jaw 33. The second jaw 34 is elastically biased in the direction of the first jaw 33 under the action of at least one compression spring 35 which is lodged in a transverse opening 36 provided in the upper part 33*a* of the first jaw 33. This compression spring 35 rests, at its end positioned on the side of the second jaw 34 on the bottom of base 32 and, at its other end, on a head 37 provided at the end of a transverse tie rod 38 which goes through the bottom of housing 36 and which is solidly affixed to the exterior of the jaw 34. Consequently, the spring 35 constantly biases the tie rod 38 towards the left in FIG. 15 and it thus tends to constantly press the second jaw 34 against the right longitudinal surface of the first jaw 33.

The heel binding 1 is adapted to be used with a slide 28 of the type integrated with the ski and which has, on at least one of its longitudinal edges 28*a*, a succession of notches 31. The heel binding 1 is delivered with its two jaws 33 and 34 separated from one another as is shown in FIG. 15. To that end, an ejectable wedge 39, solidly affixed to a pull ring 41, is inserted after manufacture between the two jaws 33 and 34 of the chuck that constitutes base 32. The thickness of wedge 39 thus inserted is selected such that the two jaws 33 and 34 are maintained separated from one another by a sufficient distance to permit the nesting of base 32 on the slide 28 and the longitudinal sliding of the base approximately to its final longitudinal position. Otherwise stated, the two jaws 33 and 34 must be separated from one another such that the distance between the ends of the two lower faces defining the hooks are greater than the width of the slide 28 so as to permit the nesting of base 32 on the slide 28 by a movement perpendicular thereto.

FIG. 16 shows the rear binding 1 nested on slide 28 with its jaws 33 and 34 separated from one another which makes it possible to slide it longitudinally to the final longitudinal position.

FIG. 17 shows the rear binding in its desired longitudinal position after withdrawal of the wedge 39. In this case, as soon as wedge 39 is removed, the two jaws 33 and 34 are tightened against one another under the action of the return spring 35 and they grip between them the two longitudinal edges 28*a* of slide 28.

The locking of the binding in the longitudinal position is ensured by the engagement of teeth (or notches), provided on one or the other of two jaws 33 and 34, or on these two jaws at the same time, in notches 31 (or on equivalent teeth) provided on one or the other longitudinal edges 28*a* of slide 28 or on the two edges thereof. In the non-limiting embodiment illustrated in FIGS. 15–17, the notches 31 are provided on the longitudinal edge 28*a* of slide 28 which is positioned on the side of the small jaw 34 and the latter supports, on the internal surface of its lower part forming a hook, at least one tooth 42 adapted to engage in one of notches 31.

If the tightening force of the two jaws 33 and 34 on the two longitudinal edges 28*a* of slide 28 is sufficiently great, one can avoid having to provide a mutual engagement of teeth and notches.

Figure 18:
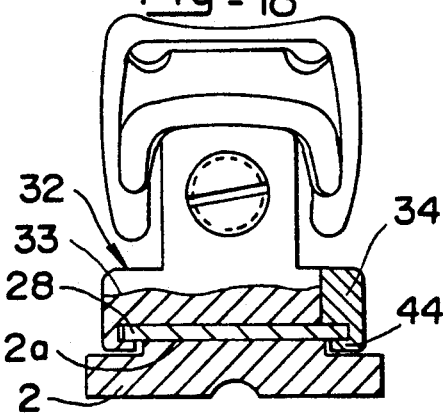
FIG. 18 is a vertical and transverse sectional view, taken from the rear, of an alternative embodiment of a rear binding.
Figure 19:
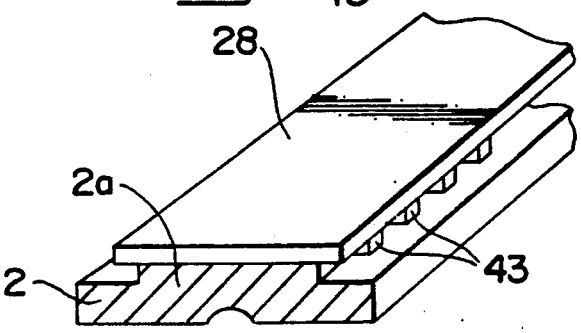
FIG. 19 is a perspective view of a slide on which the rear binding shown in FIG. 18 is mounted.

In the alternative embodiment shown in FIGS. 18 and 19, the teeth 43 used for the locking of the heel binding 1 in longitudinal position are provided along the lateral surface of projection 2*a* of ski 2, underneath the marginal parts of slide 28, between the lower surface of slide 29 and the upper surface of ski 2. With these teeth or notches defined between successive teeth 43 cooperate the notches or teeth 44 provided in the edge of the lower part in the form of a hook of the corresponding jaw, in this case of the second jaw 34 in the case of the embodiment illustrated in FIG. 18. According to the preceding description, it can be seen that the separation of the jaws 33 and 34 on the heel binding 1 removed from its delivery box permits the mounter to directly mount the body of the heel binding on slide 28, without having to proceed to any drilling or screwing operation. Then, after having brought the heel binding into the desired longitudinal position by sliding on slide 28, the mounter removes the wedge 39 and, if this is necessary, he or she slightly displaces the body of the binding in the longitudinal direction so as to attain the final position in which the binding is latched by mutual nesting of the teeth of slide 28 and of one or both jaws 33 and 34 constituting base 32.

For a subsequent modification of the adjustment of the longitudinal position of the binding, it suffices to separate from one another the two jaws 33 and 34 of the chuck that constitutes the base 32, so as to pull apart the teeth. This can be achieved by engaging with an appropriate tool, such as a flat screwdriver, in the common plane of the two jaws 33 and 34. One can also provide, at the location of the common plane, a bevel or a housing to facilitate or permit the engagement of the screwdriver blade. Then the two jaws 33 and 34 are kept separated either by means of the previously introduced tool either by inserting a new wedge that can then be removed when the new longitudinal position has been reached.

To keep the body of the rear binding 1 from pulling out of its slide 18 during a length adjustment, one can provide that the amplitude of the transverse displacement of the two jaws 33 and 34 to achieve a length adjustment, i.e., to dislodge the teeth, is less than the amplitude necessary to dislodge the base 32 from slide 28. In practice, when the teeth are positioned on a single edge 28*a* of the slide 28, it is necessary, to nest the body of the heel binding 1 on the slide or to dislodge it, to separate the two jaws 33 and 34 from one another by a distance twice the distance of separation which is necessary to achieve a length adjustment. In fact, this problem is actually posed only when the teeth are provided on the two longitudinal edges 28*a* of the slide 28 because the amplitudes are then of the same order.

There can also be provided a hard point, an abutment, or even a significant return force to overcome to pass from the particular spacing of the two jaws necessary for the length adjustment position to a greater spacing corresponding to the dislodging of the body from the slide.

FIG. 20 shows a heel binding 1 to which a ski brake 45 is fastened. This ski brake 45 comprises, in the usual manner, an upper pedal 46 upon which the ski boot rests, lateral spades 47 for effecting braking in the snow, and a base 48 on which the pedal 46 and the spades 47 are journalled. The base 48 of the ski brake 45 is affixed to base 32 of the heel binding 1 by means of one or more screws 49. If the base 32 of the heel binding 1 which is constituted by two jaws 33 and 34 is transversely extendible, it is not the same with base 48 of the brake 45 because of spades 47 which, while descending, cross the level of the base 48 and slide 28. These spades 47 can preferably be used as transverse lock to avoid a dislodging of the heel binding 1. In this case the teeth which permit the adjustment of length are situated only on one edge 28*a* of slide 28 and this is then the small jaw 34 which has the supplementary teeth. During the mounting, the brake 45 is not assembled with the body of the rear binding 1 and it is not connected to the base 32 of this body until after mounting of this base 32 on slide 28. The spades 47 then pass on each side of the ski.

When a modification of the length adjustment is made, the spades 47 constitute lateral abutments and prevent, in particular, the body of the rear binding 1 from displacing on the side of the large jaw 33, so that the large jaw 33 cannot dislodge from the slide 28. If one wishes to dislodge the body of the heel binding 1, it is necessary to first dismantle the brake 45.

FIG. 20 also shows a housing 51 which is provided in the two surfaces in contact with two jaws 33 and 34 and which opens into the upper surfaces of these jaws to permit the introduction of a tool, such as a screwdriver, making it possible to separate the two jaws 33 and 34 from one another. It can also be seen in FIG. 20 that the small jaw 34 is biased in the direction of the large jaw 33 by means of two parallel transverse tie rods 38, the housing 51 being positioned substantially in the middle between the axes of the two transverse tie rods 38.

FIG. 21 shows a front binding 16 whose base 32 is constituted of two parts 33 and 34 constituting the two jaws of a transverse collet chuck and cooperating with a slide 28 integrated into ski 2.

Although the invention has been described with reference to particular means, materials, and embodiments, it is to be understood that the invention is not limited to the particulars disclosed and extends to all equivalents within the scope of the following claims.

I claim:

1. A safety heel binding for a ski comprising:

a longitudinal slide adapted to be affixed to the ski;

a body;

a retention jaw for engagement with a rear end of a boot to be placed on the ski;

a base, said body being solidly affixed to said base, said base being longitudinally slidably mounted on said slide;

means for immobilizing said base and said body on said slide in one of a plurality of longitudinal positions, said immobilization means comprising, on one of said base and said slide, a succession of notches aligned longitudinally, forming a rack, respectively determining a plurality of longitudinal positions that said body can occupy on said slide and, on the other of said base and said slide, a latch and means for elastically biasing said latch, said latch comprising, facing said succession of notches, at least one tooth, said at least one tooth of said latch being elastically biased toward said notches, by said means for elastically biasing, for engagement in one of said notches for immobilizing said body on said slide in one of said plurality of longitudinal positions;

a removable wedge interposed between a predetermined support surface of said binding and said latch for maintaining said latch in a release position in which said tooth is separated from said latching notches and for allowing locking of said latch, by engagement of said tooth in one of said notches in response to removal of said removable wedge for said immobilizing of said body on said slide in one of said plurality of longitudinal positions;

said slide having, in a central part, said rack, with which said latch cooperates, said latch being mounted for rocking in a vertical direction, about a transverse axis, on said base of said heel binding, wherein said wedge is engaged longitudinally between an upper surface of an extreme rear part of said base and an extreme rear arm of said latch, wherein said removable wedge is solidly affixed to a tab forming a pull handle, extending longitudinally and projecting exteriorly of said binding, at a rear of said heel binding, for permitting removal of said wedge by longitudinally rearward pulling.

2. The safety binding according to claim 1, wherein said pull handle is a pull ring.

3. A safety heel binding for a ski comprising:

a longitudinal slide adapted to be affixed to the ski;

a body;

a retention jaw for engagement with a rear end of a boot to be placed on the ski;

a base, said body being solidly affixed to said base, said base being longitudinally slidably mounted on said slide;

means for immobilizing said base and said body on said slide in one of a plurality of longitudinal positions, said immobilization means comprising, on one of said base and said slide, a succession of notches aligned longitudinally, forming a rack, respectively determining a plurality of longitudinal positions that said body can occupy on said slide and, on the other of said base and said slide, a latch and means for elastically biasing said latch, said latch comprising, facing said succession of notches, at least one tooth, said at least one tooth of said latch being elastically biased toward said notches, by said means for elastically biasing, for engagement in one of said notches for immobilizing said body on said slide in one of said plurality of longitudinal positions;

a removable wedge interposed between a predetermined support surface of said binding and said latch for maintaining said latch in a release position in which said tooth is separated from said latching notches and for allowing locking of said latch, by engagement of said tooth in one of said notches in response to removal of said removable wedge for said immobilizing of said body on said slide in one of said plurality of longitudinal positions;

said slide having, in a central part, said rack, with which said latch cooperates, said latch being mounted for rocking in a vertical direction, about a transverse axis, on said base of said heel binding, wherein said wedge is engaged longitudinally between an upper surface of an extreme rear part of said base and an extreme rear arm of said latch, wherein said removable wedge is solidly affixed to a lug extending transversely through a lateral housing of said binding, projecting exteriorly, on one side of said binding, and connected to an external pull tab.

4. The safety binding according to claim 3, wherein said pull tab is a pull ring.

5. A ski binding comprising:

(a) a binding body adapted to be selectively positioned at any of a plurality of locations on a ski;

(b) a latch mounted with respect to said binding body for movement between a locked position for immobilizing said binding body with respect to said ski and an unlocked position for permitting said binding body to be moved to any of said plurality of locations on said ski;

(c) means for biasing said latch to said locked position, said locked position of said latch thereby comprising a single stable biased locked position;

(d) a support surface of said binding toward which a portion of said latch is biased by said biasing means; and (e) means for maintaining said latch in said unlocked position and for enabling said latch to be moved to said single stable biased locked position by said means for biasing said latch, comprising an element having an enlarged portion for engagement between a portion of said latch and said support surface, thereby enabling said binding body to be moved to any of said plurality of locations on said ski, whereby said latch is movable to said single stable biased locked position, by said means for biasing said latch, in response to removal of said enlarged portion of said element from between said portion of said latch and said support surface, said element further comprising a pull tab affixed to said enlarged portion for facilitating said removal.

6. The ski binding of claim 5, further comprising a slide adapted to be mounted upon said ski and wherein said binding body comprises means for slidable engagement with said slide for permitting said binding body to be longitudinally slidable along said slide.

7. The ski binding of claim 6, wherein said plurality of locations on said ski are defined by a plurality of longitudinally spaced notches provided in said slide, and wherein said latch comprises at least one tooth for selective engagement within a selected one of said plurality of notches.

8. The ski binding of claim 7, wherein said portion of said latch engaged by said element for engagement between said portion of said latch and said support surface of said binding for maintaining said latch in said unlocked position is movable between a position corresponding to said locked position of said latch and a position corresponding to said unlocked position of said latch, and wherein, in said position of said portion of said latch corresponding to said unlocked position of said latch, said at least one tooth is maintained withdrawn from said selected one of said plurality of notches.

9. The ski binding of claim 6, wherein said support surface of said binding is located between said slide and said portion of said latch, when said binding is slidably engaged with said slide.

10. The ski binding of claim 5, wherein said element includes a pull handle to facilitate removal of said element from said engagement.

11. The ski binding of claim 5, wherein said binding is a rear binding for engagement with a rear portion of a ski boot.

12. The ski binding of claim 5, wherein said binding is a front binding for engagement with a front portion of a ski boot.

13. The ski binding of claim 7, wherein said binding further includes a base upon which said body of said binding is mounted, said base comprising a slot through which said at least one tooth is adapted to project during its engagement with said selected one of said notches.

14. The ski binding of claim 13, wherein said support surface of said binding is a surface of a portion of said base.

15. The ski binding of claim 13, wherein said latch comprises an offset portion, from which said at least one tooth projects, wherein said offset portion is longitudinally movable within said slot.

16. The ski binding of claim 6, wherein said plurality of locations on said ski are defined by a plurality of longitudinally spaced notches provided in said slide, and wherein said latch comprises a generally vertically movable rod which is biased toward engagement with a selected one of said plurality of notches.

17. The ski binding of claim 16, wherein said support surface of said binding is comprised of a surface of a portion of said binding body and wherein said portion of said latch is a plate connected to said movable rod.

18. The ski binding of claim 6, wherein said latch includes a means mounted for transverse movement relative to said ski, and wherein said biasing means biases said latch in a transverse direction.

19. The ski binding of claim 18, wherein said binding further comprises a base upon which said body is mounted, wherein said base comprises a first jaw for engagement with said slide and wherein said latch comprises a second jaw for engagement with said slide, and wherein said second jaw is biased toward said first jaw by said biasing means.

20. The ski binding of claim 19, wherein said support surface of said binding is a surface of a portion of said base, and wherein said element is engageble between said second jaw and said support surface.

21. The ski binding of claim 19, wherein said plurality of locations on said ski are defined by a plurality of longitudinally spaced notches provided in said slide for engaging a portion of said latch.

22. The ski binding of claim 19, in combination with a projection of said ski upon which said slide is adapted to be mounted, wherein said plurality of locations on said ski are defined by either one of a plurality of longitudinally spaced teeth and notches provided on said projection for being engaged by a portion of said latch.

23. A safety ski binding for a ski comprising:

a longitudinal slide adapted to be affixed to the ski;

a body;

a retention jaw for engagement with one end of a boot to be placed on the ski;

a base, said body being solidly affixed to said base, said base being longitudinally slidably mounted on said slide;

means for immobilizing said base and said body on said slide in one of a plurality of longitudinal positions, said immobilization means comprising, on one of said base and said slide, a succession of notches aligned longitudinally, forming a rack, respectively determining a plurality of longitudinal positions that said body can occupy on said slide and, on the other of said base and said slide, a latch and means for elastically biasing said latch, said latch comprising, facing said succession of notches, at least one tooth, said at least one tooth of said latch being elastically biased toward said notches, by said means for elastically biasing, for engagement in one of said notches for immobilizing said body on said slide in one of said plurality of longitudinal positions;

a removable wedge interposed between a predetermined support surface of said binding and said latch for maintaining said latch in a release position in which said tooth is separated from said latching notches and for allowing locking of said latch, by engagement of said tooth in one of said notches in response to removal of said removable wedge for said immobilizing of said body on said slide in one of said plurality of longitudinal positions, wherein said body comprises a housing and said latch comprises a vertically movable rod positioned within said housing of said body;

wherein said means for elastically biasing said latch comprises a spring for downwardly biasing said latch for facilitating engagement of a lower end of said rod in one of said notches for immobilizing said body of said binding in one of said plurality of longitudinal positions;

said binding further comprising a plate which is journalled to said rod, said removable wedge being engageable in a transverse direction between said support surface and said plate for lifting said plate relative to said support surface and for raising said lower end of said rod upwardly in opposition to said means for biasing.

* * * * *